US009448048B2

(12) United States Patent
Reijo

(10) Patent No.: US 9,448,048 B2
(45) Date of Patent: Sep. 20, 2016

(54) SHELL WITH EJECTABLE SHELL BASE

(71) Applicant: BAE Systems Bofors AB, Karlskoga (SE)

(72) Inventor: Vesa Reijo, Gyttorp (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 0 days.

(21) Appl. No.: 14/769,108

(22) PCT Filed: Feb. 19, 2014

(86) PCT No.: PCT/SE2014/000021
§ 371 (c)(1),
(2) Date: Aug. 20, 2015

(87) PCT Pub. No.: WO2014/129950
PCT Pub. Date: Aug. 28, 2014

(65) Prior Publication Data

US 2016/0010966 A1 Jan. 14, 2016

(30) Foreign Application Priority Data

Feb. 22, 2013 (SE) ..... 1300141

(51) Int. Cl.
*F42B 7/08* (2006.01)
*F42B 12/62* (2006.01)

(52) U.S. Cl.
CPC ..... *F42B 12/62* (2013.01)

(58) Field of Classification Search
CPC ..... F42B 30/12; F42B 7/08; F42B 10/56; F42B 12/367
USPC ..... 102/477, 373, 451, 513, 334
See application file for complete search history.

(56) References Cited

U.S. PATENT DOCUMENTS 2,721,518 A * 10/1955 Hickman ..... F42B 30/12 102/373
3,368,489 A * 2/1968 Herter ..... F42B 7/08 102/451
3,662,683 A * 5/1972 Merritt ..... F42B 7/08 102/451
3,669,020 A * 6/1972 Waite ..... F42B 12/44 102/364
3,744,426 A 7/1973 Butler
3,911,824 A 10/1975 Barr et al.
4,043,267 A * 8/1977 Hayashi ..... F42B 7/10 102/439
4,543,885 A * 10/1985 Akhagen ..... F42B 30/12 102/288
4,574,701 A * 3/1986 Fiocchi ..... F42B 7/08 102/451
4,869,174 A 9/1989 Hanser et al.
5,299,502 A * 4/1994 Maki ..... F42B 7/08 102/449
5,429,054 A * 7/1995 Topping ..... F42B 7/08 102/451
5,861,572 A * 1/1999 Schuermann ..... F42B 7/08 102/449
5,970,878 A * 10/1999 Gardner ..... F42B 7/08 102/449
7,810,432 B2 * 10/2010 Stevens ..... F42B 7/08 102/453
D654,137 S * 2/2012 Frank ..... D22/115
D654,138 S * 2/2012 Frank ..... D22/115
8,276,519 B2 * 10/2012 Menefee, III ..... F42B 7/02 102/450
2004/0134372 A1 7/2004 Scherer et al.

FOREIGN PATENT DOCUMENTS

EP 0195854 A2 10/1986

* cited by examiner

*Primary Examiner* — Michael David
(74) *Attorney, Agent, or Firm* — Polsinelli PC

(57) ABSTRACT

The present invention relates to a shell (1) comprising a shell casing (2), a detonator (3), a payload (4), a shell base (5) and a separation charge (6) intended for ejection of the payload (4) and the shell base (5) from the shell (1) over a target area. The invention is characterized in that the shell base (5), following separation from the shell (1), can be divided into smaller parts which are harmless for the environment.

3 Claims, 2 Drawing Sheets

SHELL WITH EJECTABLE SHELL BASE

CROSS REFERENCE TO RELATED APPLICATIONS

Figure 1:
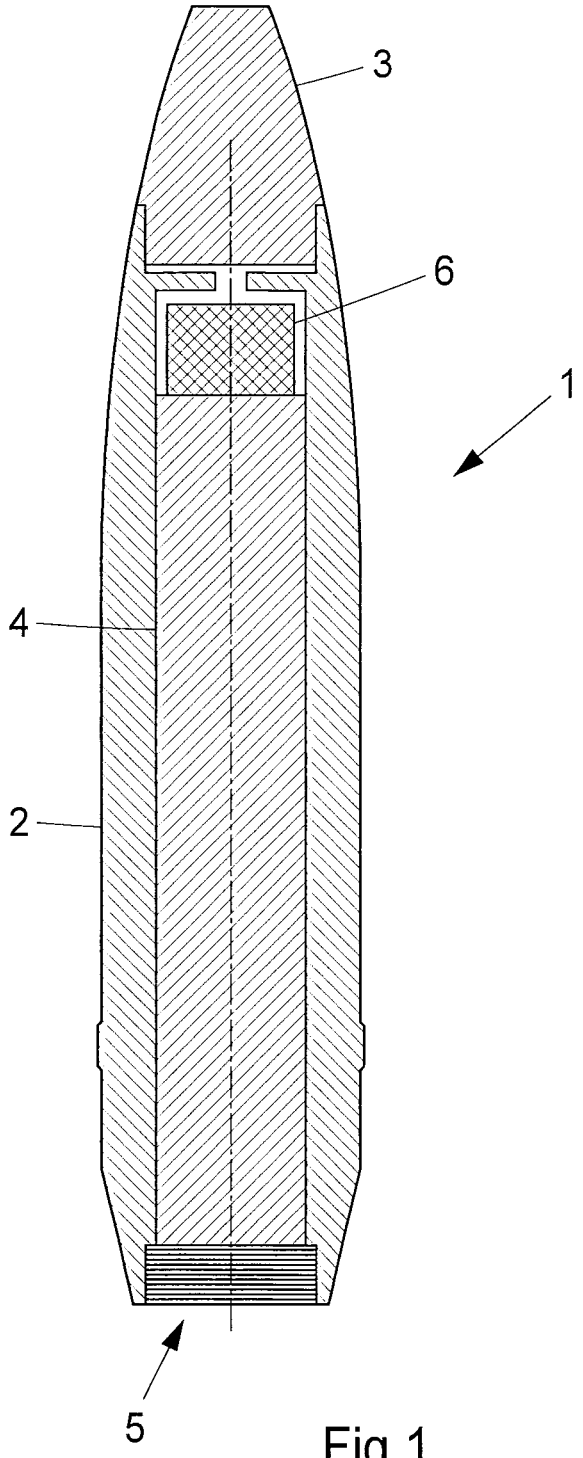

This application is a National Phase filing under 35 U.S.C. §371 of PCT/SE2014/000021 filed on Feb. 19, 2014; and this application claims priority to Application No. 1300141-7 filed in Sweden on Feb. 22, 2014. The entire contents of each application are hereby incorporated by reference.

TECHNICAL FIELD

The present invention relates to a load-carrying shell, comprising a shell base, intended for release of a payload over a target area.

BACKGROUND AND PRIOR ART

Load-carrying shells, also referred to as shells, which are used for the release of payloads, for example one or more explosive charges, over a military target area, normally release the payload by a parting charge, also referred to as a separation charge, separating the payload from the shell by ejection of the payload and the shell base from the shell in the rearward direction of the shell. The payload, which is intended to hit a military target area, comprises a self-destruction unit, which is activated and destroys the payload if no target is detected. The payload thus poses no risk for humans in the environment. The shell base, on the other hand, which constitutes a heavy lump of metal that is ejected simultaneously with the payload, does pose a risk for the environment.

A projectile intended for training purposes, in which the rear of the said projectile comprises a rear stop part 31, a steel plate 27, and one or more washers 25, is shown and described in patent document U.S. Pat. No. 3,902,683 A. The structure of the projectile means that the projectile is more easily split up into smaller and harmless parts upon impact with a target, so that the proportion of dangerous splinters is thus reduced.

OBJECT OF THE INVENTION AND ITS DISTINGUISHING FEATURES

A principal object of the present invention is a shell, comprising a shell base, in which the shell base, following separation from the shell, is configured for minimum risk to humans in the environment.

A further object of the invention is a shell, comprising a shell base, wherein the configuration of the shell base allows simple adaptation for different charge sizes in a launcher.

The said objects, and others which are not enumerated here, are satisfactorily met by virtue of that which is specified in the present independent patent claim.

Embodiments of the invention are specified in the dependent patent claims.

Thus, according to the present invention, a shell comprising a shell casing, a detonator, a payload and a separation charge intended for ejection of the payload and the shell base from the shell has been provided. The shell is characterized in that the shell base, following the separation from the shell, can be divided into smaller parts which are harmless for the environment.

According to further aspects of the shell:

the shell base comprises a cylindrical container comprising an upper, open end face part and a lower, closed end face part, a disc-shaped cap detachably mounted on the upper, open end face part, and the cylindrical container comprises at least two closely packed discs, the discs are 0.58 mm thick, circular and made of steel, and the number of discs is 58, the cylindrical container and the lower, closed end face part are dimensioned to rupture under a given shearing force in the rearward direction of the shell upon ejection of the payload from the shell, the discs, following ejection of the shell base, can be divided into smaller disc parts via engraved kerfs on the discs.

Advantages and Effects of the Invention

The invention implies a number of advantages and effects, the most important of which are:

the divisibility of the shell base into smaller parts following separation from the shell means a minimal risk for the environment;

the structure of the shell base with closely packed discs in a cylindrical container means that the shell base can be easily adapted for different charge sizes in a launcher by the choice of a necessary number of discs.

The invention has been defined in the following patent claims and shall now be described in somewhat greater detail in connection with the appended figures.

Figure 2:
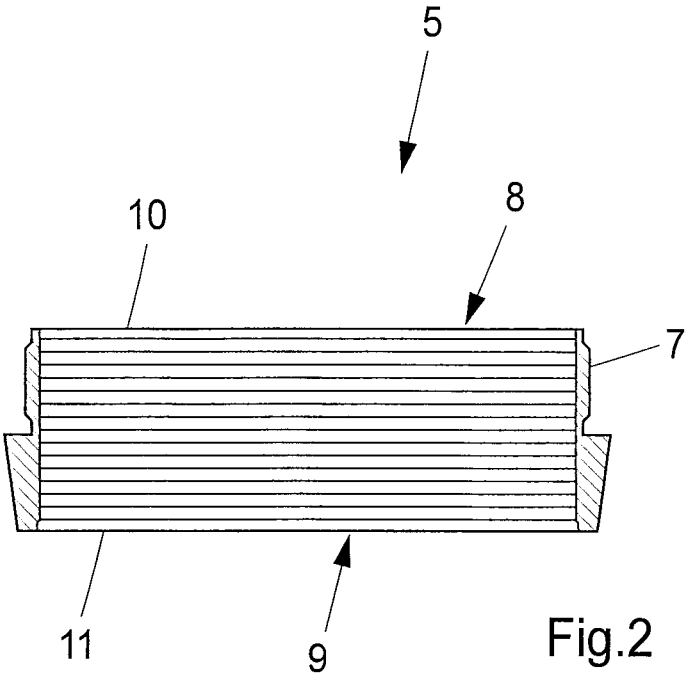

Further advantages and effects will emerge upon study and consideration of the following, detailed description of the invention with simultaneous reference to the appended drawing figures, in which:

FIG. 1 shows in schematic representation a shell according to the invention, comprising a shell casing, a detonator, a payload, a shell base and a separation charge, FIG. 2 shows in schematic representation an enlargement of the shell base according to FIG. 1.

DETAILED DESCRIPTION OF EMBODIMENTS

FIG. 1 shows a preferred embodiment of a shell 1 according to the invention, comprising a shell casing 2, a detonator 3 in the shape of a nose cone, a payload 4 disposed inside the shell casing 2, a shell base 5 and a separation charge 6, disposed in the shell casing 2 between the detonator 3 and the payload 4.

The separation charge 6 is constituted, preferably, by a powder charge, which is initiated in response to a signal from the electronic detonator 3 via a pyrotechnical primer, wherein the gas pressure which is generated from the powder charge forces the payload 4 and the shell base 5 out from the shell casing 2 in the rearward direction of the shell 1. The detonator 3 can either be pre-programmed or remote-controlled via, for example, GPS.

The payload 4 comprises one or more sub-charges, which, for example, can comprise explosive, smoke or fire compositions, intended for release over a military target area. In order to prevent accidental injury to humans in the environment outside the target area, explosive-containing sub-charges comprise a self-destruction unit, which is activated and destroys the sub-charge if no target can be detected. The self-destruction unit is of known type and is therefore not described in detail in the continued text.

The shell base 5, FIG. 2, is configured to be dividable, upon separation from the shell 1, into smaller parts which are harmless for the environment. The shell base 5 comprises a cylindrical container 7, comprising an upper, open end face part 8 and a lower, closed end face part 9.

The container 7 comprises at least two, preferably thirty to sixty, circularly shaped discs 11 closely packed one upon the other in the cylindrical container 7.

The number of necessary discs 11 is determined, inter alia, by the force to which the shell base 5 is subjected when the shell 1 is fired from a launcher.

Following packing of the discs 11 in the container 7, the shell base 5 is closed off by the detachable mounting of a disc-shaped cap 10, preferably of metal, onto the upper, open end face part 8.

The container 7 is fastened in the shell casing 2, preferably by threading or grooving. The fastening of the shell container 6, like the lower, closed end face part 9, is dimensioned to rupture under a given shearing force which is generated in the rearward direction of the shell 1 upon ejection of the payload 4. The discs 11 are preferably made of a metallic material, preferably steel, but in an alternative embodiment can also be made of a fibre-reinforced plastic. The thickness of the discs 10 is preferably 0.58 mm.

In an alternative embodiment, each disc 11 can also be divided into smaller disc parts via engraved kerfs on the surface of the disc 11. The kerfs preferably have the shape of linear grooves, which extend radially from the centre of the disc 11 to the periphery of the disc 11. The discs 11 are packed such that the kerfs are displaced relative to one another in order to avoid fractures in the discs 11 upon the launch of the shell 1.

The invention is not limited to shown embodiments but can be varied in different ways within the scope of the patent claims. It will be appreciated, for example, that the number and size, material and shape of the elements and parts which make up the shell and which are of importance to the invention can be adapted with regard to different calibres of the shell 1.

The invention claimed is:

1. A shell comprising a shell casing, a detonator, a payload, a shell base and a parting charge for ejection of the payload and the shell base from the shell over a target area, wherein the shell base, following separation from the shell, can be divided into smaller parts which are harmless for the environment, wherein the shell base comprises a cylindrical container comprising an upper, open end face part and a lower, closed end face part, and a disc-shaped cap detachably mounted on the upper open end face part, and wherein the cylindrical container comprises at least two closely packed discs, wherein the discs, following ejection of the shell base, can be divided into smaller disc parts via engraved kerfs on the discs.

2. The shell according to claim 1, wherein the discs are 0.58 mm thick, circular and made of steel, and in that the number of discs is within the range 30-60.

3. The shell according to claim 1, wherein the cylindrical container-and the lower, closed end face part are dimensioned to rupture under a given shearing force in the rearward direction of the shell upon ejection of the payload from the shell.

* * * * *